US005791396A

United States Patent [19]

Oda et al.

[11] Patent Number: 5,791,396

[45] Date of Patent: Aug. 11, 1998

[54] APPARATUS AND METHOD FOR PRODUCING MOLDS

[75] Inventors: Shigeo Oda, Toyokawa; Ryoji Kanayama, Toyohashi; Kuniyasu Mori; Kazuo Sugimoto, both of Toyokawa, all of Japan

[73] Assignee: Sintokogio, Ltd., Tokyo, Japan

[21] Appl. No.: 778,484

[22] Filed: Jan. 3, 1997

Related U.S. Application Data

[63] Continuation of Ser. No. 661,761, Jun. 11, 1996, Pat. No. 5,660,221.

[30] Foreign Application Priority Data

| | | | |
|---|---|---|---|
| Jun. 16, 1995 | [JP] | Japan | 7-174396 |
| Jun. 23, 1995 | [JP] | Japan | 7-180988 |
| Jan. 19, 1996 | [JP] | Japan | 8-026067 |
| Feb. 23, 1996 | [JP] | Japan | 8-061981 |

[51] Int. Cl.[6] ..... B22C 15/02

[52] U.S. Cl. ..... 164/37; 164/38; 164/195; 164/207

[58] Field of Search ..... 164/37, 38, 169, 164/195, 207

[56] References Cited

FOREIGN PATENT DOCUMENTS

| | | | |
|---|---|---|---|
| 60-83742 | 5/1985 | Japan | 164/37 |
| 60-145245 | 7/1985 | Japan | 164/37 |
| 63-21577 | 5/1988 | Japan . | |
| 1-278938 | 11/1989 | Japan | 164/37 |
| 3-142038 | 6/1991 | Japan | 164/207 |
| 4-28453 | 1/1992 | Japan . | |
| 4-123842 | 4/1992 | Japan | 164/37 |
| 4-158951 | 6/1992 | Japan | 164/169 |

*Primary Examiner*—J. Reed Batten, Jr.
*Attorney, Agent, or Firm*—Limbach & Limbach L.L.P.

[57] ABSTRACT

Molding sand (S) is put in a mold space defined by a pattern plate (2), having a pattern (2A) on it, and a flask (3). The apparatus includes a thin-plate body (9) and/or a rod (11) to be inserted into the molding sand. It is pre-compacted at a part of it near the inner and outer surfaces of the pattern (2A) and the inner surfaces of the flask (3) by the thin-plate body and rod. The apparatus also has a pressing plate (8) to press all the molding sand after it is pre-compacted.

13 Claims, 10 Drawing Sheets

APPARATUS AND METHOD FOR PRODUCING MOLDS

This is a continuation of application Ser. No. 08/661,761, filed Jun. 11, 1996 and now U.S. Pat. No. 5,660,221.

FIELD OF THE INVENTION

This invention relates to an apparatus and a method for producing a mold by pressing molding sand which is put in a mold space defined by a flask, and a pattern plate, having a pattern thereon.

PRIOR ART

In a conventional mold-producing method wherein molding sand is pressed, it tends not to be well compacted at places near the lower inner surface of a flask, particularly the corners of the flask, and at places near the inner and outer surfaces of a pattern, particularly at pockets or depressions between ridges of the pattern.

This inferior compaction is caused because the molding sand is not dense, or not consolidated, near the inner wall of the flask, when it is put in the mold space, and because the force to press the molding sand is not well transmitted to the part of it near the inner and outer surfaces of the pattern and the inner surface of the flask due to the friction between these surfaces and the molding sand. A mold having any part which is not dense, or not consolidated, tends to deform, particularly when it is filled with molten metal. Thus it fails to produce a good cast of accurate dimensions. In the prior art, many methods have been used to compact molding sand sufficiently. For example, jolts are used to strike molding sand to pre-compact it. In another method compressed air is circulated through molding sand to pre-compact it. In yet another method, a press plate that has elements projecting downward from the periphery of its bottom is used to pre-compact molding sand at a part of it near the internal surface of the flask.

However, pre-compaction by means of jolts give impulses and vibrations to the mold and flask, and it also causes noises. Therefore, the mold and flask must be durable to withstand such impulses and vibrations. Using a device that has multi-segment squeeze feet requires the same number of cylinders as the number of segment squeeze feet. Further, each segment squeeze foot is limited, to some extent, to a large size, due to its mechanical structure. Pre-compaction by circulating the compressed air requires durable pneumatic equipment and durable seal mechanisms, due to the high pressure of the air. Also, the pneumatic equipment tends to be bulky. To use a pressing plate that has elements projecting downward from the periphery of its bottom does not compact molding sand well at any part other than where the elements exist.

Japanese Patent B (KOKOKU), 63-21577, discloses a device that pre-compacts molding sand for a mold by means of many cylinders having piston rods directed downward and to be inserted into the molding sand. The device has also a squeeze plate to press all the molding sand after the piston rods are withdrawn from the molding sand. This device also requires as many cylinders as the number of multi-segment squeeze feet, and therefore it becomes bulky.

Japanese Patent A (KOKAI), 4-28453 discloses a method to compact molding sand, wherein a plurality of points on the molding sand are previously selected in a program, and wherein these points are successively pressed first by a single pressing rod that moves to the selected points, and then all the molding sand is pressed by a squeeze member.

However, a device to perform this method is complicated, and this method takes a lot of time to pre-compact the molding sand.

SUMMARY OF THE INVENTION

This invention is conceived in view of the above drawbacks of the prior art. The purpose of the invention is to provide an apparatus and a method to produce a mold wherein molding sand is well consolidated at any part that tends not to be well consolidated by the above conventional methods. To this end, the device of the present invention includes a thin plate and/or a rod that is inserted into molding sand, which is put in a mold space defined by a pattern plate, having a pattern thereon, and a flask, at a part or position of it that is slightly apart from the inner surface of the flask and the inner and outer surfaces of the pattern. Thus the molding sand is pre-compacted at that part of it. The device also has a pressing plate to press all the molding sand after it is pre-compacted.

In the method of the present invention the thin plate and/or rod is inserted into the molding sand to pre-compact it at any part that tends not to be well consolidated. The thin plate and/or rod is then withdrawn from the molding sand. After this, the top surface of the molding sand may be leveled. After the pre-compaction by the thin plate and/or rod, all the molding sand is pressed by the pressing plate.

The apparatus of the present invention may include a tube made of a thin plate that pre-compacts molding sand at a part that is slightly apart from the inner surface of the flask. The tube may be square, rectangular, or circular. Preferably the cross section of the tube is similar to, but slightly smaller than, that of the inner surface of the flask.

The structures and advantages of the present invention other than those described above will be explained below in detail in the Description of the Preferred Embodiments, by reference to the accompanying drawings.

DESCRIPTION OF THE PREFERRED EMBODIMENTS

Figure 1:
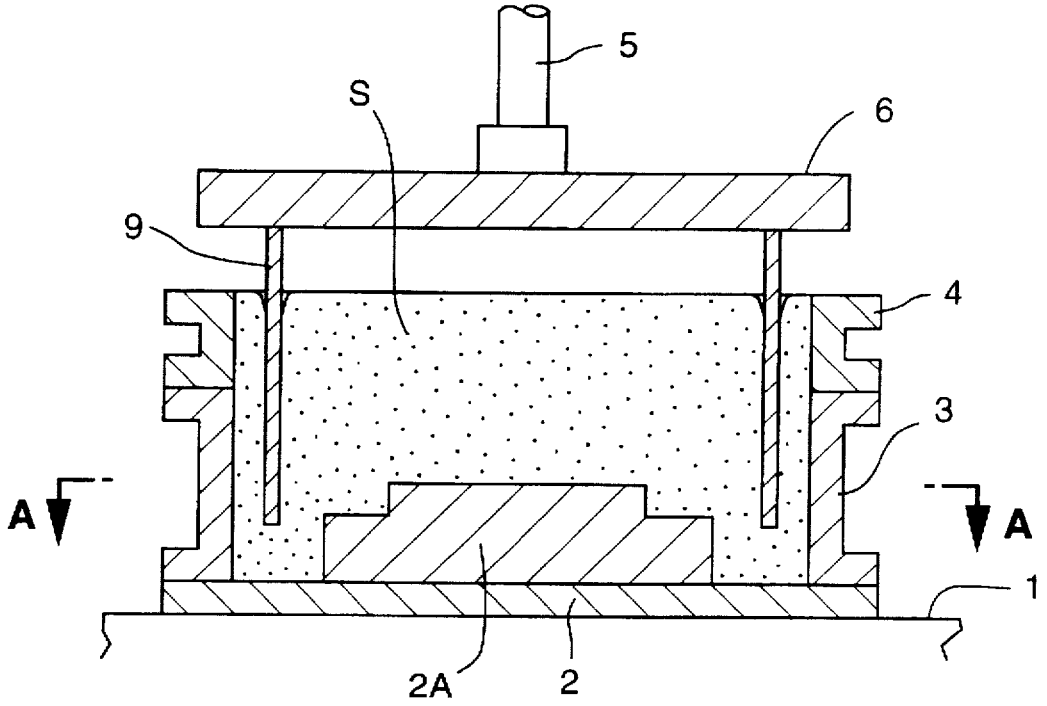
FIG. 1 is a sectional view of a part (an element to pre-compact molding sand in a flask) of the apparatus of the present invention.
Figure 2:
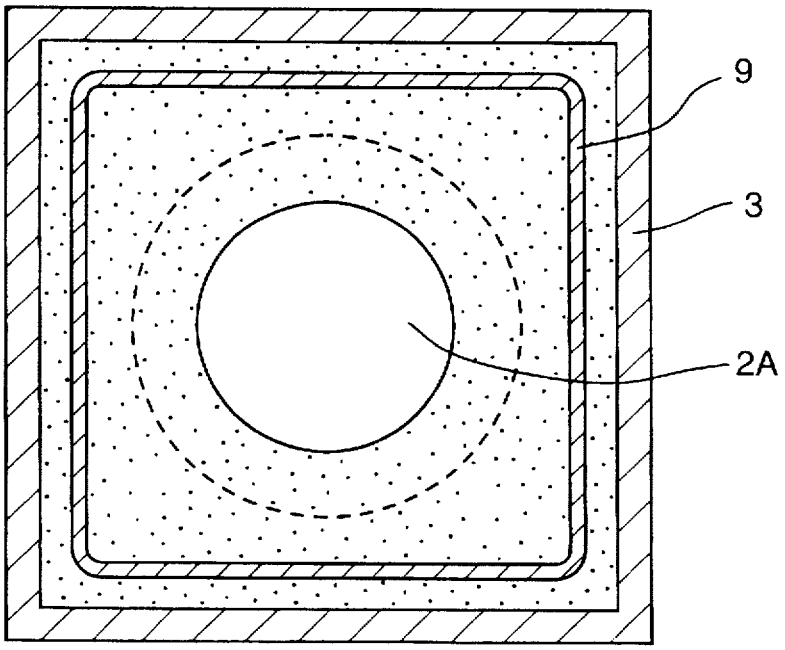
FIG. 2 is a cross-sectional view along arrow A—A in FIG. 1.
Figure 3:
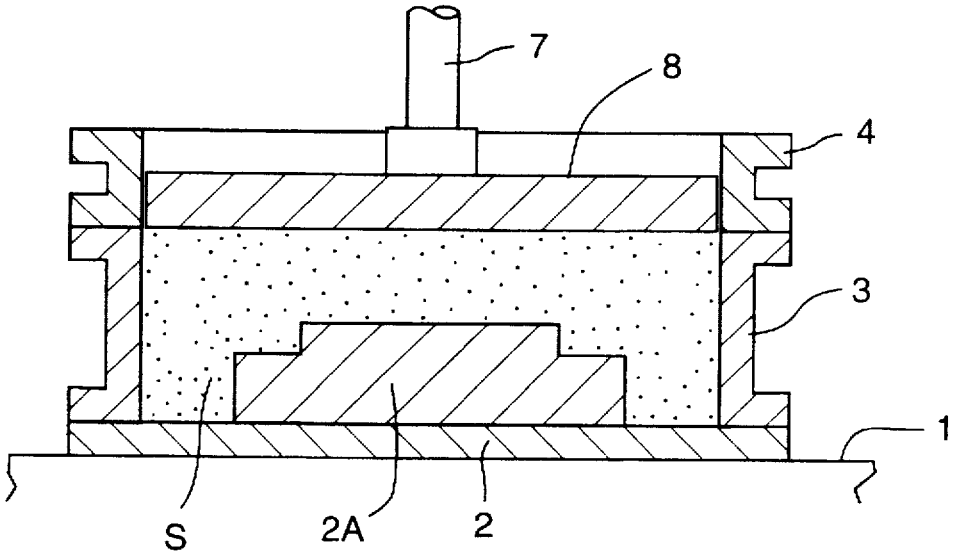
FIG. 3 is a sectional view of a part (an element to press all the molding sand in the flask after the pre-compaction) of the apparatus in FIG. 1.

FIGS. 1, 2, and 3 show an embodiment of a part of the apparatus of the present invention to produce a mold. FIGS. 1 and 2 show a pre-compacting element 9, which pre-compacts molding sand S fed in a mold space defined by a pattern plate 2, a flask 3, and a filling frame 4. FIG. 3 shows an element 8, which presses all the molding sand in the mold space after the pre-compaction by the element 9.

Again in FIG. 1, the pattern plate 2 is put on a table 1. The pattern plate 2 has a pattern 2A on it. The flask 3 and filling frame 4 are mounted on the pattern plate, thereby defining the mold space. A rigid plate 6 is secured to a piston rod 5 of a cylinder (not shown). This cylinder can move horizontally such that it can be located just above and horizontally out of the mold space by a known method, for example, as disclosed in Japanese Patent A (KOKAI), 4-28453. The element 9, which is in the shape of a square tube of a thin rigid plate as in FIG. 2, is secured to the bottom of the rigid plate 6. The length of the tube is equal to the total height of the flask 3 and filling frame 4. When the piston rod 5 is lowered to its dead point, almost all of the tube 9 is inserted into the molding sand at a place or position slightly spaced apart from the inner surface of the flask 3 and filling frame 4. The distal end of the tube 9 stops at a position slightly above the pattern plate 2. Thus the tube consolidates the molding sand at a part of the sand that is slightly spaced apart from the inner surface of the flask and filing frame. Then the piston rod 5 is retracted to withdraw the tube from the molding sand S. The cylinder (not shown) is horizontally moved out of the mold space.

Then, as in FIG. 3, the element 8, i.e. a pressing plate, is located just above the mold space. The pressing plate 8 is secured to a cylinder rod 7 of a cylinder (not shown). The cylinder that operates this rod 7 also moves horizontally, the same as the cylinder that operates the piston rod 5. Thus the pressing plate 8 is located above the mold space. After the pre-compaction by the tube 9, the pressing plate 8 is lowered to press all the molding sand. Thus all the molding sand is well compacted.

Figure 4:
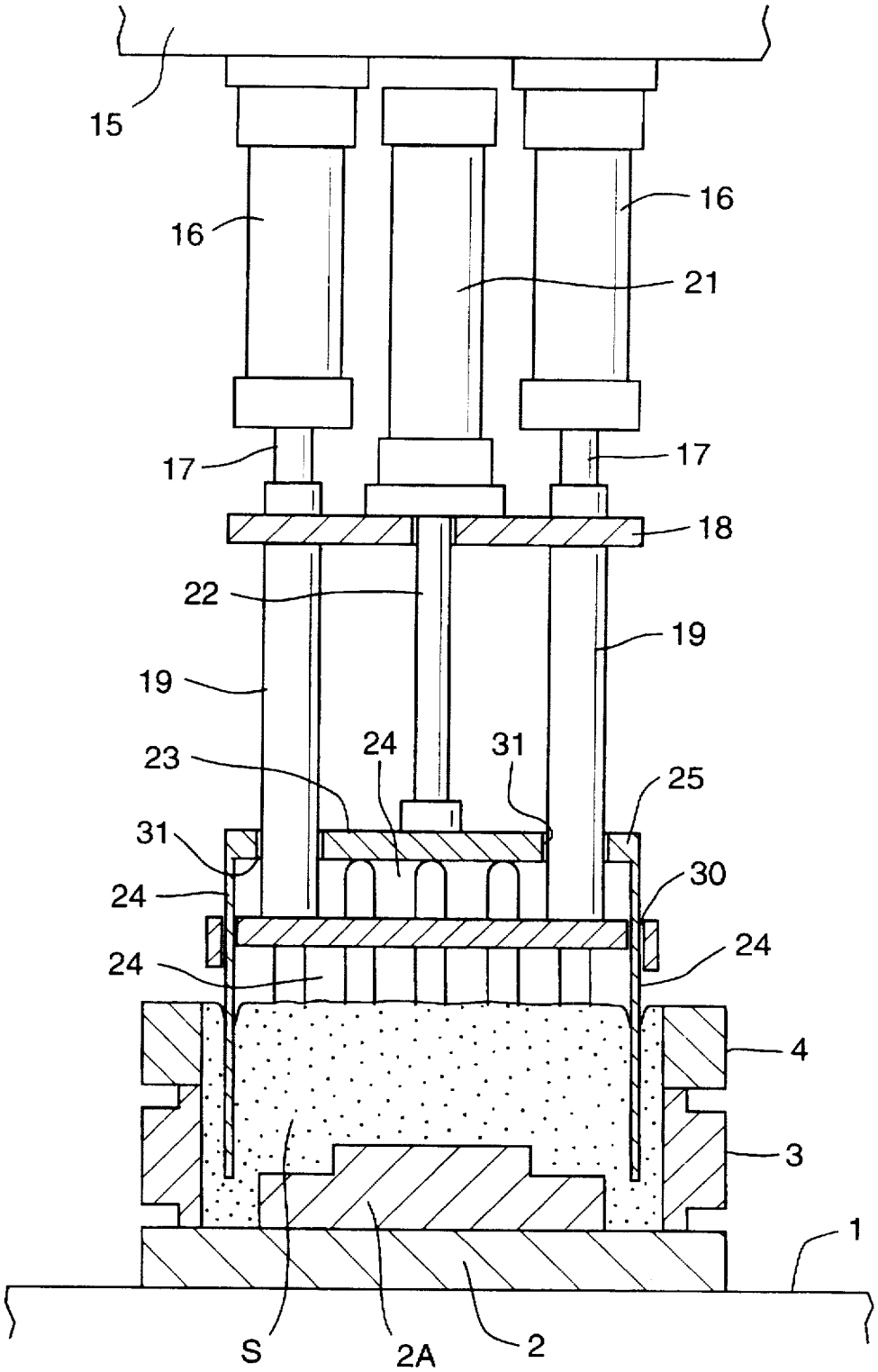
FIG. 4 is a partially cross-sectional view of an embodiment of the apparatus of the present invention.

FIG. 4 is a partially cross-sectional view of an embodiment of the apparatus of the present invention. The apparatus has two cylinders 16, 16 and a central cylinder 21. The cylinders 16, 16 are suspended from an overhead frame 15. A rigid bearing plate 18 is secured to piston rods 17, 17 of the cylinders 16, 16. A plurality of vertical rods 19, 19 are attached to the bearing plate 18 at their upper ends. A pressing plate 20 is secured to the lower ends of the vertical rods 19, 19 so that the bottom of the pressing plate 20 faces the upper surface of molding sand in a mold space defined by a pattern plate 2, flask 3, and filling frame 4.

The central cylinder 21 is mounted on the bearing plate 18 such that its piston rod 22 is free to pass through the bearing plate. A tubular body 23 is fixed to the distal end of the piston rod 22. The tubular body 23 has a top plate 25 and a plurality of thin plates 24, which are secured to the bottom of the top plate 25, and which are equidistantly spaced apart. The top plate 25 of the tubular body 23 is formed with apertures 31, 31 through which the vertical rods 19, 19 can freely pass. The pressing plate 20 is formed with apertures 30 at its periphery so that the thin plates 24 can freely pass through them when the piston rod is lowered.

The piston rod 22 is lowered until the distal ends of the thin plates 24 reach a level slightly above the pattern plate 2. When the thin plates 24 are inserted into the molding sand S, they are positioned slightly spaced apart from the inner surface of the flask 3 and the filling frame 4. Thus the molding sand in the mold space is pre-compacted at the lower periphery of it.

Figure 5:
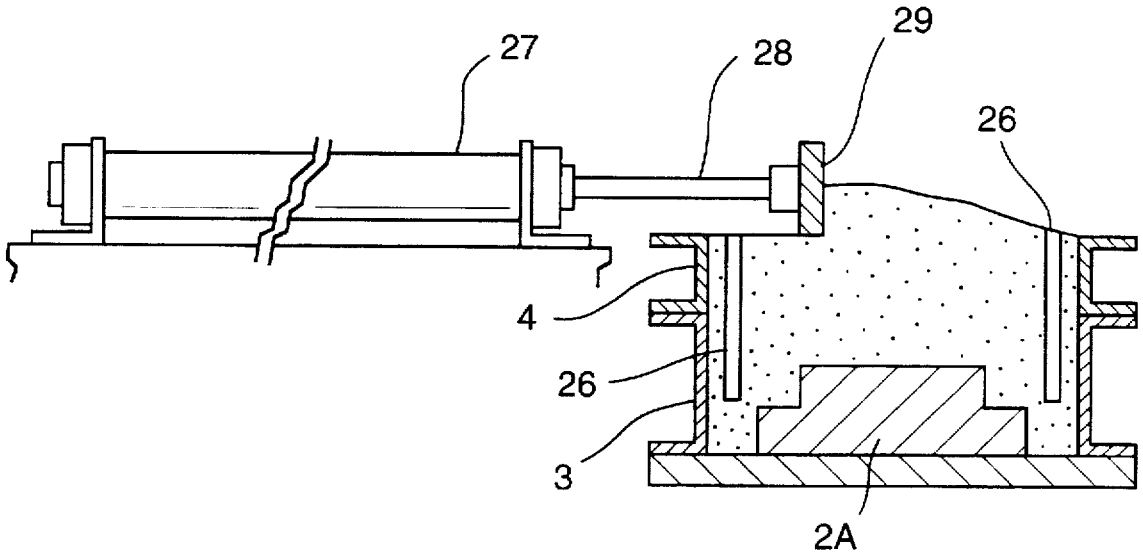
FIG. 5 is a partially cross-sectional view of a device to level the molding sand in the flask.

Then the thin plates 24 are withdrawn from the molding sand S by retracting the piston rod 22. Preferably each thin plate 24 is less than 20 mm thick. If it is too thick, cavities 26 are left in the molding sand, as in FIG. 5, when the plates 24 are withdrawn. After the thin plates 24 are withdrawn, usually the upper surface of the molding sand becomes convex, as in FIG. 5. To level this convex molding sand, a leveling device 27 is disposed beside the flask 3 and filing frame 4. The leveling device 27 may be a cylinder having a piston rod 28, as in FIG. 5. A plate 29 is attached to one end of the piston rod 28 so as to level the molding sand.

After leveling the molding sand, the vertical rods 19, 19, which carry the pressing plate 20, are lowered to press all the molding sand S by the pressing plate 20. Thus all the molding sand S is well consolidated.

Figure 6:
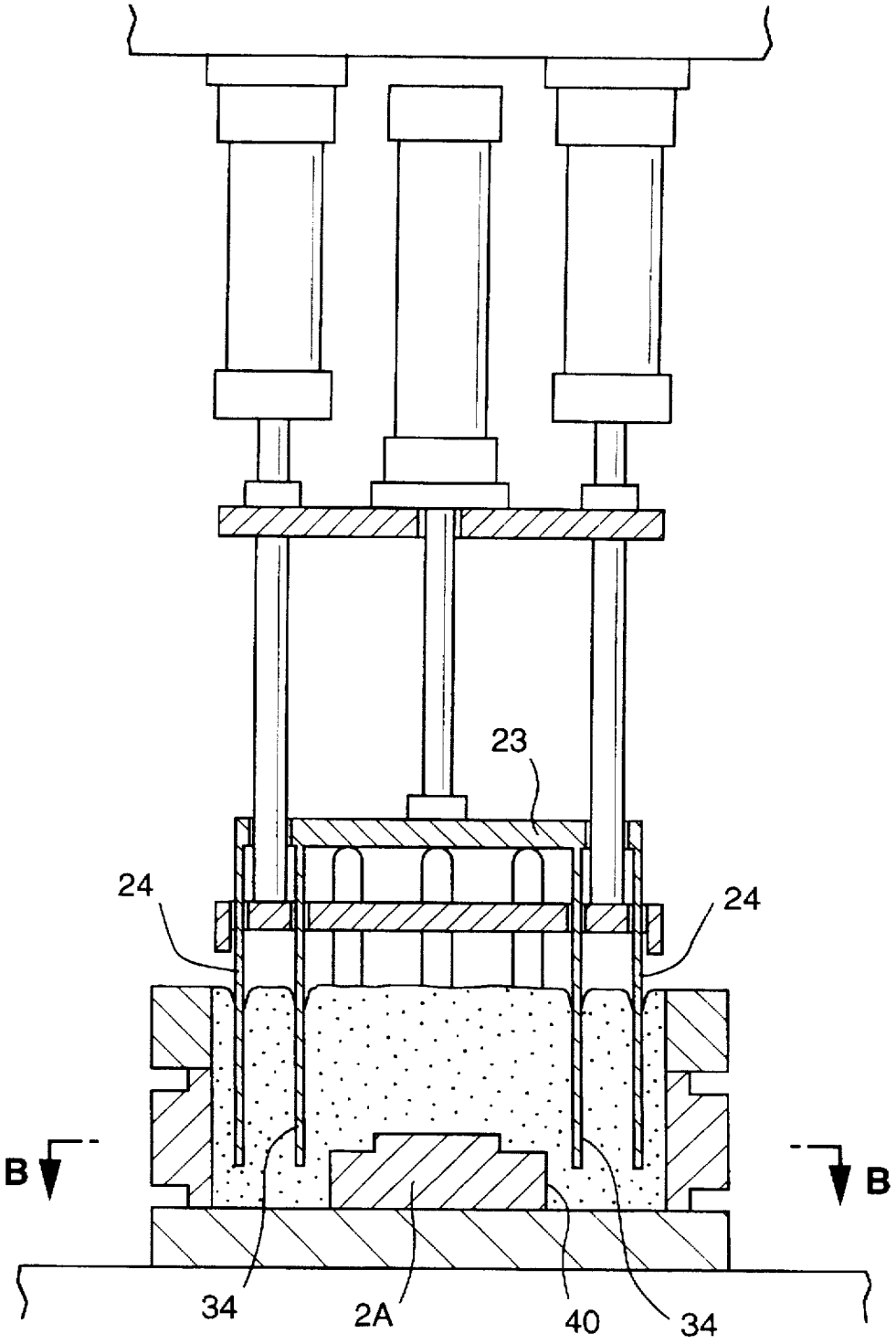
FIG. 6 is a partially cross-sectional view of another embodiment of the apparatus of the present invention.
Figure 7:
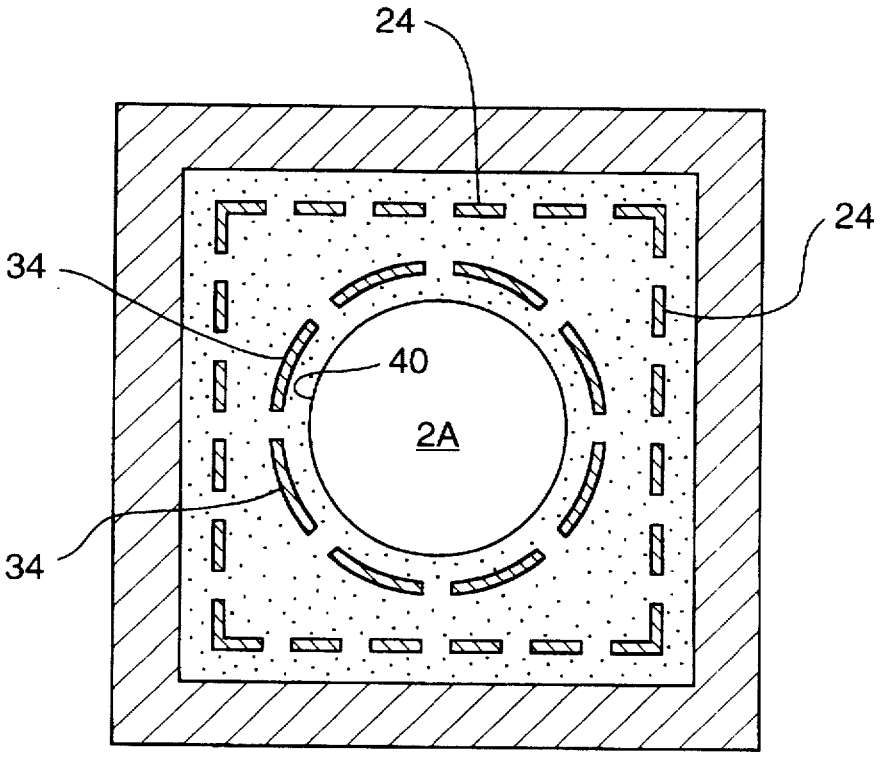
FIG. 7 is a cross-sectional view along arrow B—B in FIG. 6.

In FIGS. 6 and 7 another embodiment of the apparatus of the present invention is shown. This apparatus is similar to that in FIG. 4. The only difference is that the tubular body 23 has not only the peripheral thin plates 24, but also a plurality of intermediate thin plates 34, 34, which are equidistantly spaced apart, and which surround the outer surface 40 of the pattern 2A when inserted into the molding sand. When the thin plates 34, 34 are inserted into the molding sand, they are positioned laterally and slightly spaced apart from the outer surface 40 of the pattern 2A. In this embodiment the molding sand is pre-compacted at the lower part of it near the outer surface 40 of the pattern 2A and the inner surface of the flask 3.

Figure 8:
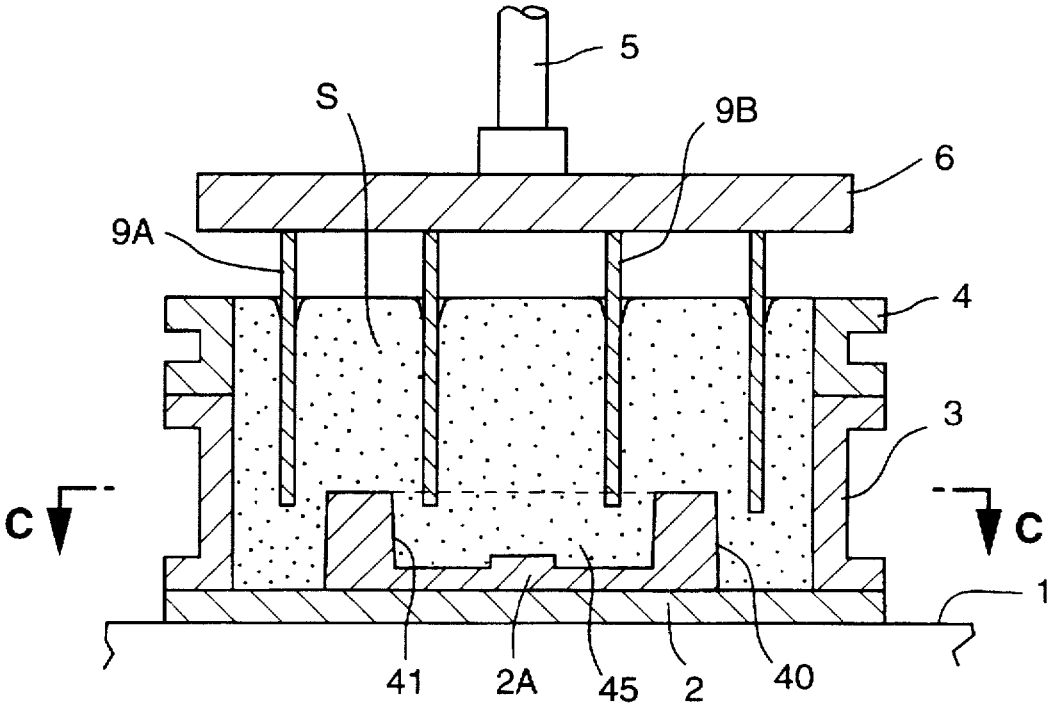
FIG. 8 is a cross-sectional view of another embodiment of the pre-compacting element.
Figure 9:
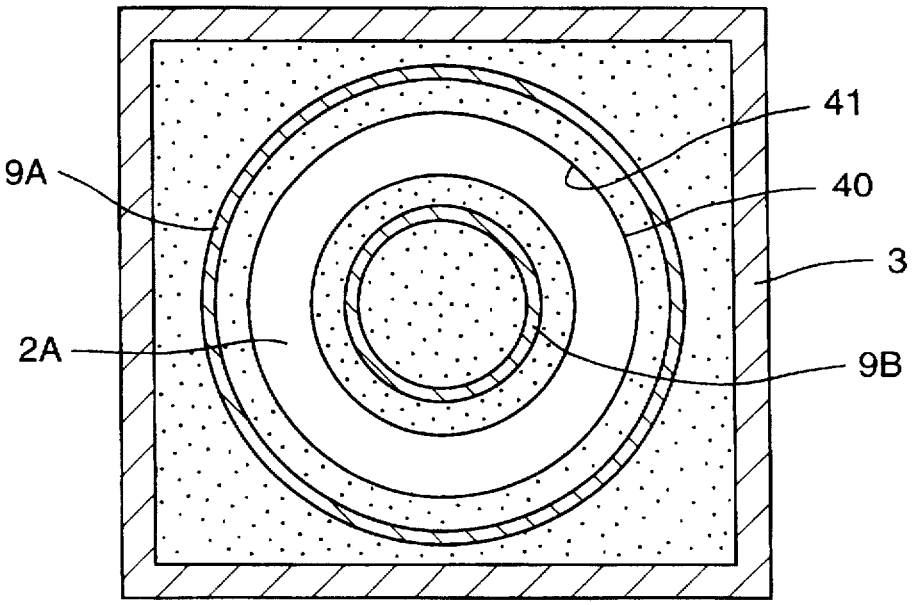
FIG. 9 is a cross-sectional view along arrow C—C in FIG. 8.

FIGS. 8 and 9 are similar to FIGS. 1 and 2 respectively. The pattern 2A has a pocket 45 and outer and inner surfaces 40, 41. An outer tube 9A of a thin plate and an inner tube 9B of a thin plate are secured to the rigid plate 6. The cross sections of the outer and inner tubes are circular and similar to those of the outer surface 40 and the inner surface 41 respectively of the pattern 2A. When the outer and inner tubes 9A, 9B are inserted into the molding sand (and into the pocket 45), the inner tube 9B is slightly spaced apart from the inner surface 41 of the pattern 2A, while the outer tube 9A is slightly spaced apart from the outer surface 40 of the pattern and the inner surface of the flask 3. Thus the molding sand is pre-compacted at the parts of it near the outer and inner surfaces 40 and 41 of the pattern 2A and the inner surface of the flask 3. After the pre-compaction, all the molding sand is pressed by the pressing plate 8, as in FIG. 3.

Figure 10:
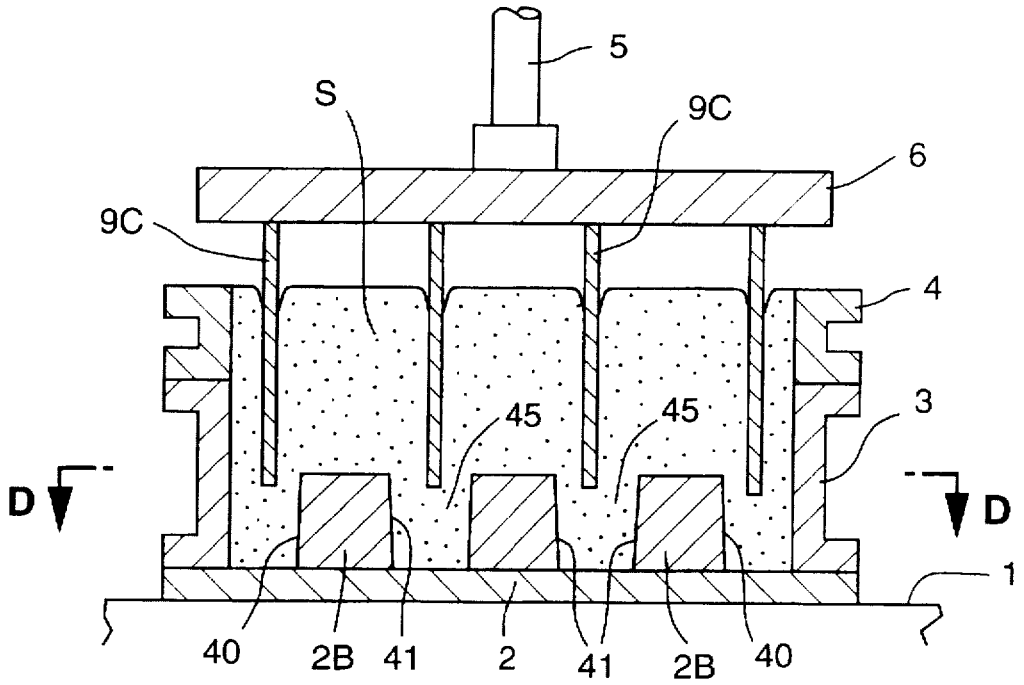
FIG. 10 is a cross-sectional view of another embodiment of the pre-compacting element.
Figure 11:
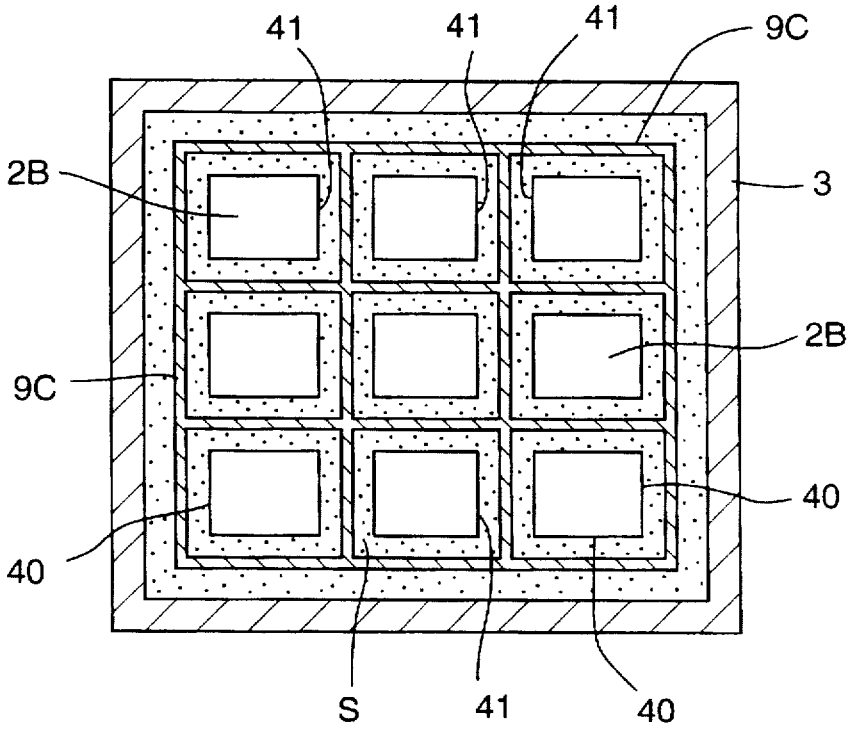
FIG. 11 is a cross-sectional view along arrow D—D in FIG. 10.

FIGS. 10 and 11 are similar to FIGS. 8 and 9 respectively. In this embodiment a plurality of identical patterns 2B are mounted on the pattern plate 2. Thus there are many pockets 45 between the patterns 2B. Each pattern has one, or more than one, outer surface 40 and/or inner surface 41. A plurality of thin plates 9c, which form a grid, are secured to the rigid plate 6 so that they are disposed in positions slightly spaced apart from the outer and inner surfaces 40, 41 of the patterns 2B when the thin plates are inserted into the molding sand. In this embodiment the molding sand is pre-compacted by the thin plates 9c at the parts of it near all the outer and inner surfaces 40, 41 of the patterns.

Figure 12:
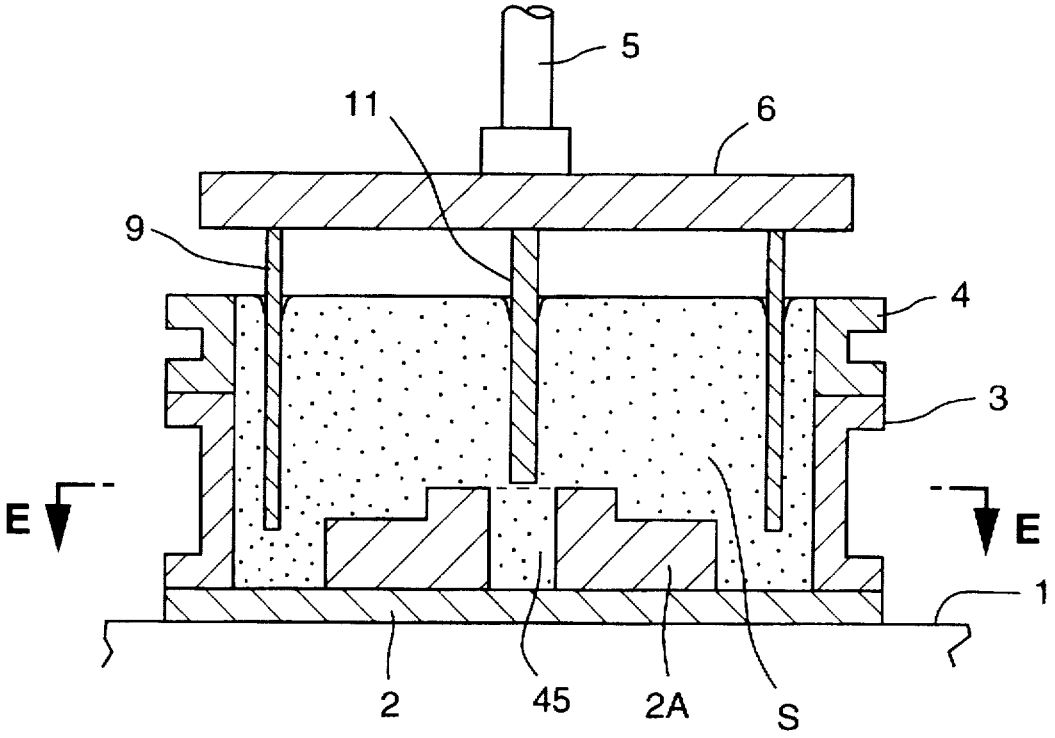
FIG. 12 is a cross-sectional view of another embodiment of the pre-compacting element.
Figure 13:
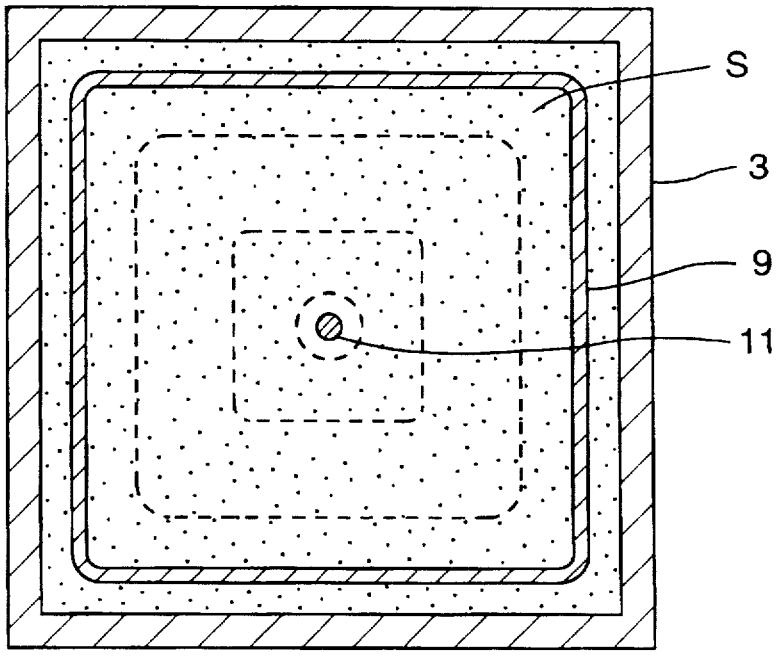
FIG. 13 is a cross-sectional view along arrow E—E in FIG. 12.

FIGS. 12 and 13 are similar to FIGS. 1 and 2 respectively. In this embodiment a pattern 2A is an almost rectangular block having a central and cylindrical throughbore, or pocket 45. A square tube 9 of a thin plate and a rod 11 are attached to the rigid plate 6. When the tube 9 and rod 11 are inserted into the molding sand S, the tube 9 is positioned slightly spaced apart from the inner surfaces of the flask 3 and filing frame 4, and the rod 11 is positioned slightly above the center of the pocket 45. In this embodiment the molding sand S is pre-compacted by the tube 9 and rod 11 at the pocket 45 and the lower periphery of it near the inner surface of the flask 3.

Figure 14:
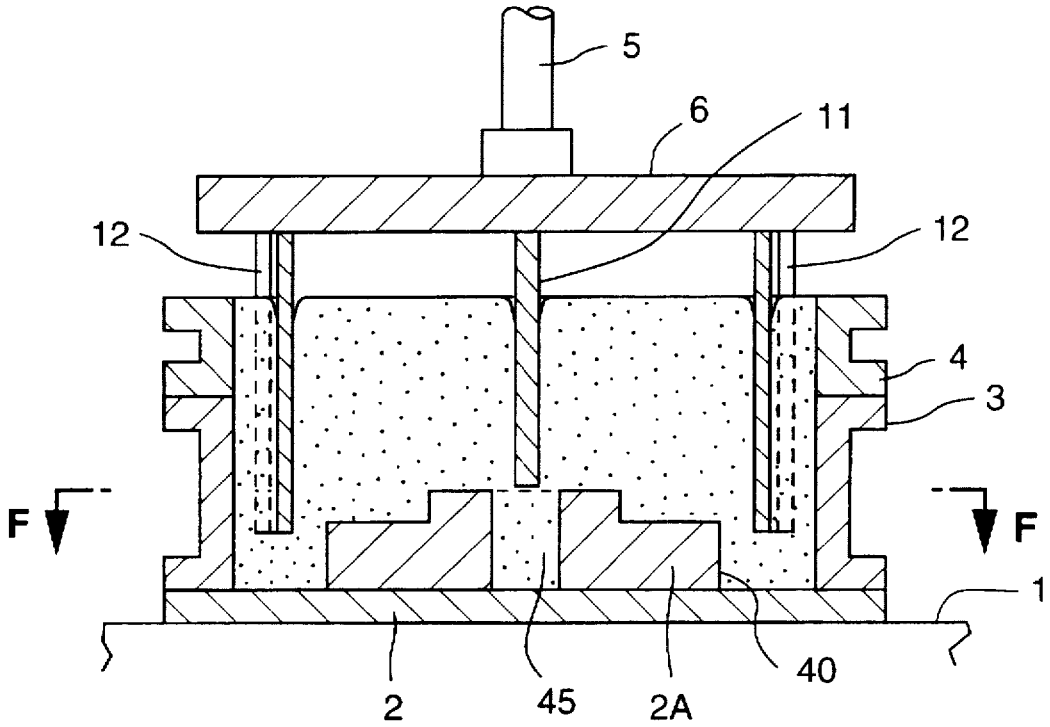
FIG. 14 is a cross-sectional view of another embodiment of the pre-compacting element.
Figure 15:
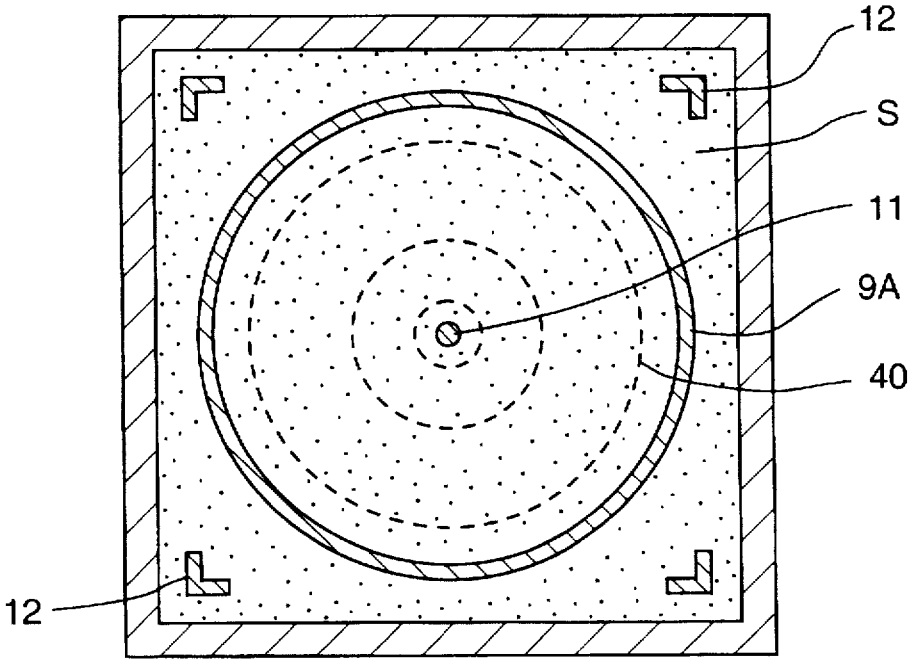
FIG. 15 is a cross-sectional view along arrow F—F in FIG. 14.

FIGS. 14 and 15 are similar to FIGS. 12 and 13 respectively. A pattern 2A is an almost cylindrical body having a central and cylindrical throughbore, or pocket 45. A circular tube 9A, a central rod 11, and four angle rods 12, are all attached to the rigid plate 6. When these members 9A, 11, 12, which are attached to the plate 6, are inserted into the molding sand, the rod 11 is positioned the same as is the rod 11 of FIG. 12. The circular tube 9 is positioned slightly apart from the outer surface 40 of the pattern 2A. The rods 12 are positioned at the inner corners of the flask 3, and are slightly spaced apart from the inner surface of the flask 3 and filling frame 4. Thus in this embodiment the molding sand S is pre-compacted at the pocket 45 and at the lower periphery of it near the outer surface 40 of the pattern and near the inner corner of the flask 3. Since the part of the tube 9A that is located between the rods 12 and 12 is slightly spaced apart from the inner surface of the flask the same distance as the rods 12, 12 spaced apart from the flask, the molding sand is also pre-compacted at the part between the rods 12 and 12.

The embodiments described above are only exemplary, and the present invention is not limited to them. Clearly many variations of the thin plates and rods and many combinations of the thin plates and/or rods are possible. Many plates and rods of different sizes or shapes can be used in light of the shapes of the patterns and flask. Also, clearly other devices may be used to move the thin plates, rods, and pressing plate. Thus the scope of present invention is limited by the following claims.

What we claim is:

1. An apparatus for producing a mold by compacting molding sand which is put in a mold space defined by a pattern plate having a pattern, and a flask, comprising:

first thin plate means disposed above said mold space, said thin plate means being movable into said mold space relative to said mold space, said thin plate means being movable to and away from a position in said mold space, and said position being slightly spaced apart from the inner surface of said flask when said thin plate means is inserted into the molding sand; and pressing means disposed above said mold space, said pressing means being movable into and away from the mold space so as to press all the molding sand.

2. The apparatus of claim 1, wherein said thin plate means includes a tubular body, the cross section of which is similar to that of the inner surface of said flask.

3. The apparatus of claim 1, further comprising second thin plates means movable into said mold space relative to said mold space, said second thin plates means being movable to and away from a position in said mold space, said position being spaced slightly apart from at least one of the inner and outer surfaces of said pattern when said second thin plate means is inserted into the molding sand.

4. The apparatus of claim 1, further comprising a rod that is movable into said mold space relative to said mold space, said rod being movable to and away from a position in said mold space, said position being spaced slightly apart from at least any one of the inner and outer surfaces of said pattern and the inner surface of said flask.

5. The apparatus of claim 3, further comprising a rod that is movable into said mold space relative to said mold space, said rod being movable to and away from a position in said mold space, said position being slightly spaced apart from at least one of the inner and outer surfaces of said pattern and the inner surface of said flask.

6. The apparatus of claim 2, wherein said pressing means is within said tubular body.

7. The apparatus of claim 3, further comprising a single member and a single cylinder that moves said member toward and away from said mold space relative to said mold space, wherein said first and second thin plate means are secured to said member.

8. An apparatus for producing a mold by compacting molding sand which is put in a mold space defined by a pattern plate having a pattern, and a flask, comprising:

thin plate means disposed above said mold space, said thin plate means being movable into said mold space relative to said mold space, and said thin plate means being movable to and away from a position in said mold space, said position being slightly spaced apart from the inner and outer surfaces of said pattern when said thin plate means is inserted into the molding sand, and pressing means disposed above said mold space, said pressing means being movable into and away from the mold space so as to press all the molding sand.

9. The apparatus of claim 8, further comprising a rod that is movable into said mold space relative to said mold space, said rod being movable to and away from a position in said mold space, said position being slightly spaced apart from at least any one of the inner and outer surfaces of said pattern and the inner surface of said flask.

10. A method for producing a mold by compacting molding sand in a mold space defined by a pattern plate and a flask, comprising the steps of:

putting molding sand in the mold space;

moving a tubular body of a thin plate towards said pattern plate relative to said pattern plate, said tubular body having a cross section similar to, but slightly smaller than, that of the inner surface of said flask, thereby inserting said tubular body into the molding sand to pre-compact the molding sand;

withdrawing said tubular body from the molding sand; and pressing all the molding sand by pressing means.

11. A method for producing a mold by compacting molding sand in a mold space defined by a pattern plate having a pattern thereon, and a flask, comprising the steps of:

putting molding sand in the mold space;

moving a thin-plate body, which is positioned above the mold space and laterally and slightly spaced apart from at least any one of the inner and outer surfaces of said pattern, towards said pattern plate relative to said pattern plate, thereby inserting said thin-plate body into the molding sand to pre-compact the molding sand at a part thereof near any one of said inner and outer surfaces of said pattern;

withdrawing said thin-plate body from the molding sand; and pressing all the molding sand by pressing means.

12. A method for producing a mold by compacting molding sand in a mold space defined by a pattern plate having a pattern thereon, and a flask, comprising the steps of:

putting molding sand in the mold space;

moving a thin-plate body and a rod, which are positioned above the mold space and laterally and slightly spaced apart from at least any one of the inner and outer surfaces of said pattern and the inner surface of said flask, toward said pattern plate relative to said pattern plate, thereby inserting said thin-plate body and rod into the molding sand to pre-compact the molding sand at a part thereof near any one of said inner and outer surfaces of said pattern and said inner surface of said flask, withdrawing said thin-plate body and said rod from the molding sand; and pressing all the molding sand by pressing means.

13. A method for producing a mold by compacting molding sand in a mold space defined by a pattern plate having a pattern thereon, and a flask, using an actuator including a single piston having a fixed longitudinal axis and a single cylinder to which the piston is mounted, and using a thin-plate body and/or a rod attached to the actuator, said piston being mounted with freedom to move along the axis but without freedom to move perpendicular to the axis, said method comprising the step of:

putting molding sand in the mold space;

operating the actuator to move the thin-plate body and/or the rod from a position above the mold space and laterally and slightly spaced apart from at least one of the inner and outer surfaces of said pattern plate and the inner surface of said flask, toward said pattern plate, thereby inserting said thin-plate body and/or said rod into the molding sand to pre-compact the molding sand at a part thereof near said at least one of said inner and outer surfaces of said pattern plate and said inner surface of said flask;

withdrawing said thin-plate body and/or said rod from the molding sand;

leveling the entire upper surface of the molding sand; and pressing at least substantially all the molding sand toward the pattern plate.

* * * * *